US005445105A

United States Patent [19]

Chen et al.

[11] Patent Number: 5,445,105

[45] Date of Patent: Aug. 29, 1995

[54] TORQUE BALANCED POSTSWIRL PROPULSOR UNIT AND METHOD FOR ELIMINATING TORQUE ON A SUBMERGED BODY

[75] Inventors: Benjamin Y.-H. Chen; Carol L. Tseng, both of Potomac, both of Md.; Frank B. Peterson, McLean, Va.

[73] Assignee: The United States of America as represented by the Secretary of the Navy, Washington, D.C.

[21] Appl. No.: 313,617

[22] Filed: Sep. 30, 1994

[51] Int. Cl.[6] ..... B63G 8/08

[52] U.S. Cl. ..... 114/338; 440/66

[58] Field of Search ..... 440/49, 66, 67, 68, 440/80; 114/333, 338, 339, 340; 60/221; 416/223 R, 244 B, 203, 202, 176

[56] References Cited

U.S. PATENT DOCUMENTS

| | | | |
|---|---|---|---|
| 2,727,485 | 12/1955 | Combs | 440/80 |
| 3,678,872 | 7/1972 | Migliaccio et al. | 114/338 |
| 4,798,547 | 1/1989 | Gearhart | 440/66 |

OTHER PUBLICATIONS

Chen, Benjamin Y.-H. and Carol L. Tseng "A Postswirl Propulsor For a Small Vehicle." Propellers/-Shafting '94 Symposium (Sep. 1994), pp. 1-1 to 1-7.

Chen, Benjamin Y.-H. "Postswirl Propulsors—A Design Method and An Application." Carderock Division Naval Surface Warfare Center Report CARDEEROCKDIV-92/011 (Sep. 1992).

*Primary Examiner*—Stephen Avila

*Attorney, Agent, or Firm*—Gary G. Borda

[57] ABSTRACT

A torque balanced propulsor unit for a submersible vehicle of the type having a bow, a stern, a longitudinally extending central section axisymmetric about a longitudinal axis of the vehicle and including therein a maximum diameter of the vehicle, and a tapered aft section axisymmetric about the longitudinal axis is provided. The torque balanced propulsor unit includes a rotor for providing a forward thrust to the vehicle. The rotor includes a central axisymmetric hub and a plurality of circumferentially spaced apart impeller blades extending radially from the central hub. The rotor is rotationally mounted to the tapered aft section of the vehicle. The rotor has a first torque associated therewith. The torque balanced propulsor unit further includes a stator for producing a second torque on the vehicle. The stator is secured to the vehicle at a location aft of the rotor. The stator includes a plurality of circumferentially spaced apart stationary vanes fixed to the vehicle and extending radially therefrom, the vanes being shaped to produce the second torque. The stator is configured and positioned so as to function within the wake of the rotor to produce the second torque, wherein the second torque is substantially equal and opposite the first torque.

12 Claims, 7 Drawing Sheets

TORQUE BALANCED POSTSWIRL PROPULSOR UNIT AND METHOD FOR ELIMINATING TORQUE ON A SUBMERGED BODY

STATEMENT OF GOVERNMENT RIGHTS

The invention described herein may be manufactured and used by or for the Government of the United States of America for governmental purposes without the payment of any royalties thereon or therefor.

BACKGROUND OF THE INVENTION

1. Field of Invention

The present invention relates generally to propulsors for submersible vehicles and, more particularly, to a torque balanced postswirl propulsor unit for a submersible vehicle and a method for eliminating operational torque on a submersible vehicle.

2. Brief Description of Related Art

An operating problem associated with submersible vehicles, particularly small vehicles such as torpedoes and remotely controlled or autonomous underwater vehicles, is maintaining operational stability, specifically roll stability, while being propelled by a rotating propulsor. Roll stability (zero roll underway) can be accomplished if the vehicle achieves a torque balance under operating conditions. Moreover, submersible vehicles having small maximum transverse dimensions, e.g., hullforms comprising small-diameter bodies of revolution having small maximum diameters, can dedicate only limited internal volume to propulsion machinery. Additionally, for small submersible vehicles, the installed power available for propulsion is limited by machinery weight and volume considerations, thus, necessitating the minimizing of propulsion machinery weight and volume.

Conventional single rotation (SR) propellers have simple machinery arrangements that occupy limited internal volume. However, SR propulsors are incapable of providing torque balance to the vehicle. Consequently, large control surfaces are required to maintain roll stability. However, large control surfaces significantly increase the resistance and, thus, decrease the speed-power performance of the vehicle.

Contrarotating (CR) propellers can, in some cases, achieve torque balance. However, CR propellers require complex shafting and gearing arrangements that add weight and occupy large amounts of internal space. Consequently, in spite of the hydrodynamic benefits of CR propellers, complex shafting and gearing arrangements have restricted the application of CR propulsors in small vehicles.

Thus, there is a need to provide a propulsor that provides torque balance for enhanced stability and improved performance to submersible vehicle of all sizes. More particularly, there is a need to provide a propulsor for small submersible vehicles that both incorporates a simple, small, lightweight machinery arrangement and provides vehicle stability enhancement.

OBJECTS OF THE INVENTION

Accordingly, it is an object of the present invention to provide a torque balanced propulsor that enhances operating stability of submersible vehicles.

It is a further object of the present invention to provide a propulsor having a simplified machinery arrangement, which will thus provide additional useful internal space in small submersible vehicles, while maintaining torque balance under operating conditions.

Other objects and advantages of the present invention will become apparent to those skilled in the art upon a reading of the following detailed description taken in conjunction with the drawings and the claims supported thereby.

SUMMARY OF THE INVENTION

In accordance with one embodiment of the present invention, the objects and advantages are accomplished by a torque balanced propulsor unit for a submersible vehicle. In a preferred embodiment, the vehicle is a small submersible having a small maximum transverse dimension, and more particularly, the vehicle may nominally be a body of revolution having a small maximum diameter. The vehicle for which the propulsor unit is intended is of the type having a bow and a stern, and situated therebetween a forward section having a rounded nose, a longitudinally extending central section including therein a maximum transverse dimension of the vehicle, and a tapered aft section. Generally, the forward and aft sections are nominally axisymmetric about a longitudinal axis of the vehicle. The longitudinally extending central section need not be axisymmetric, but may include any cross-sectional shape. However, if the central section is axisymmetric, it includes therein the maximum diameter of the vehicle. The torque balanced propulsor unit includes rotating means, having a first torque associated therewith, for providing forward thrust to the vehicle and stationary means for cancelling the torque associated with the rotating means. The rotating means is adapted for being rotationally mounted to the aft section of the vehicle. The stationary means is adapted for being secured to the vehicle at a location aft of the rotating means. Moreover, the stationary means is configured and positioned so as to function within the wake of water generated and propelled aft by the rotating means, and thus received by the stationary means, to produce a second torque that is substantially equal and opposite the first torque at a predetermined operating point. In so doing, the stationary means advantageously cancels torque associated with the propulsor unit so as to transfer a negligible or zero resulting torque to the vehicle.

In accordance with a further embodiment of the present invention a submersible vehicle having a torque balanced propulsor unit is provided. The submersible vehicle and torque balanced propulsor unit includes a small diameter submersible vehicle, rotating means rotatably mounted on the vehicle for providing a forward thrust to the vehicle, and stationary means secured to the vehicle for cancelling the torque associated with the rotating means. The vehicle is of the type having a bow and a stern, and forward, central and aft sections therebetween, wherein the forward, central and aft sections are nominally axisymmetric about a longitudinal axis of the vehicle, and further wherein the central section includes; therein the maximum diameter of the vehicle. The central section of the vehicle may be of the type having a constant diameter. The aft section is tapered. The rotating means is rotatably mounted to the aft section of the vehicle and has a first torque associated therewith. The stationary means is secured to the vehicle at a location aft of the rotating means, and is configured and positioned so as to function within the wake of the rotating means to produce a second torque that is substantially equal and opposite the first torque at a predetermined operating point. In so doing, the stationary means advantageously cancels torque associated with the propulsor unit so as to transfer a negligible or zero resulting torque to the vehicle.

In accordance with still a further aspect of the present invention, a method for eliminating torque on a submersible body of revolution having a single rotating propulsor unit is disclosed. The method includes the steps of mounting a rotating means on the body of revolution for providing a forward thrust to the body, the rotating means being located at a tapered aft section of the body and having a first torque associated therewith, and fixedly attaching a stationary means to the body at a location aft of the rotating means and within a wake of the rotating means, the stationary means for producing a second torque, the second torque being substantially equal and opposite the first torque.

In accordance with the embodiments disclosed above, the rotating means and the stationary means are located relative to each other such that the axial spacing between the longitudinal (fore-aft) centerplane of the rotating means and the longitudinal centerplane of the stationary means is equal to between about 30% and about 50% of the diameter of the rotating means. The rotating means comprises a rotor or propeller having a central axisymmetric hub conforming to a shape of the aft section of the vehicle, and a plurality of circumferentially spaced apart impeller or propeller blades extending radially therefrom. The hub has an axis of rotation and is adapted for being mounted for rotation on a rotating shaft of the vehicle. The rotor blades are shaped to produce the thrust and torque associated with the rotating rotor or propeller. The rotor generally has a diameter less than or equal to about 96% of the maximum transverse dimension of the vehicle. The stationary means comprises a stator having a plurality of stationary vanes adapted to be fixed to the vehicle in a circumferentially spaced arrangement. The vanes are shaped to produce the torque associated with the stator when the stator is functioning in the wake of the rotating rotor or propeller. The stator generally has a diameter less than or equal to about 85% of a diameter of the rotor. The plurality of blades and vanes have chordlengths and spans associated therewith. The rotor or propeller generally has an odd number of blades. The stator generally has an odd number of vanes with the number of stator vanes being greater than the number of impeller or propeller blades. Furthermore, the chordlength and circulation of the blades or vanes are determined to ensure that the blade section lift coefficients of the rotor and stator are less than about 0.5 and 0.2, respectively.

BRIEF DESCRIPTION OF THE DRAWINGS

The foregoing objects and other advantages of the present invention will be more fully understood by reference to the following description taken in conjunction with the accompanying drawings wherein like reference numerals refer to like or corresponding element throughout and wherein.

DETAILED DESCRIPTION OF THE PREFERRED EMBODIMENT

Figure 1:
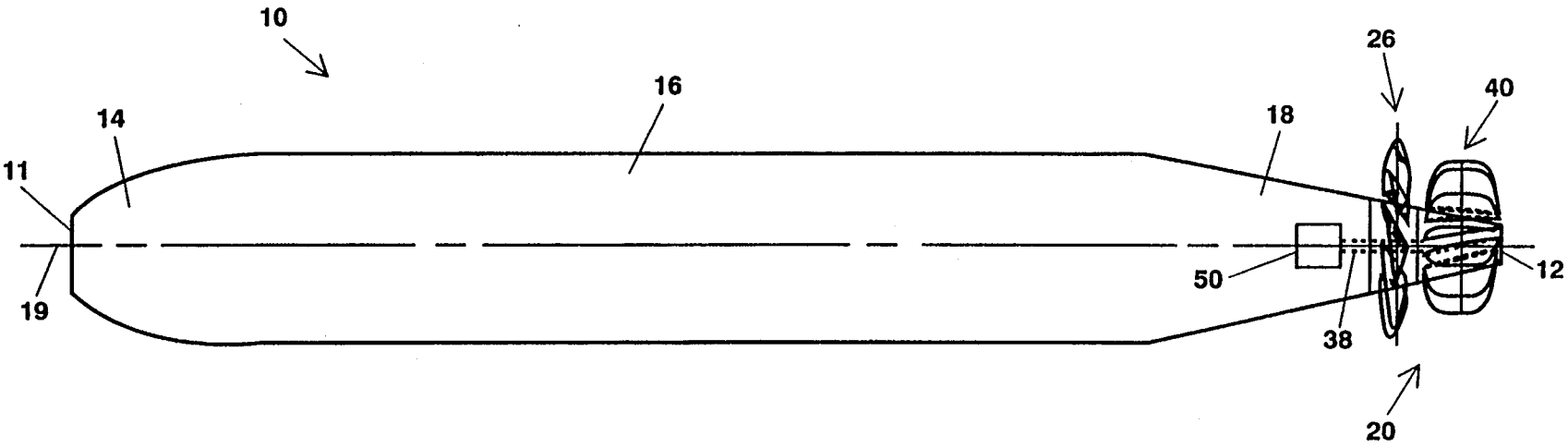
FIG. 1. is a side view of one aspect of the present invention showing the torque balanced postswirl propulsor unit mounted on a submersible vehicle.
Figure 2:
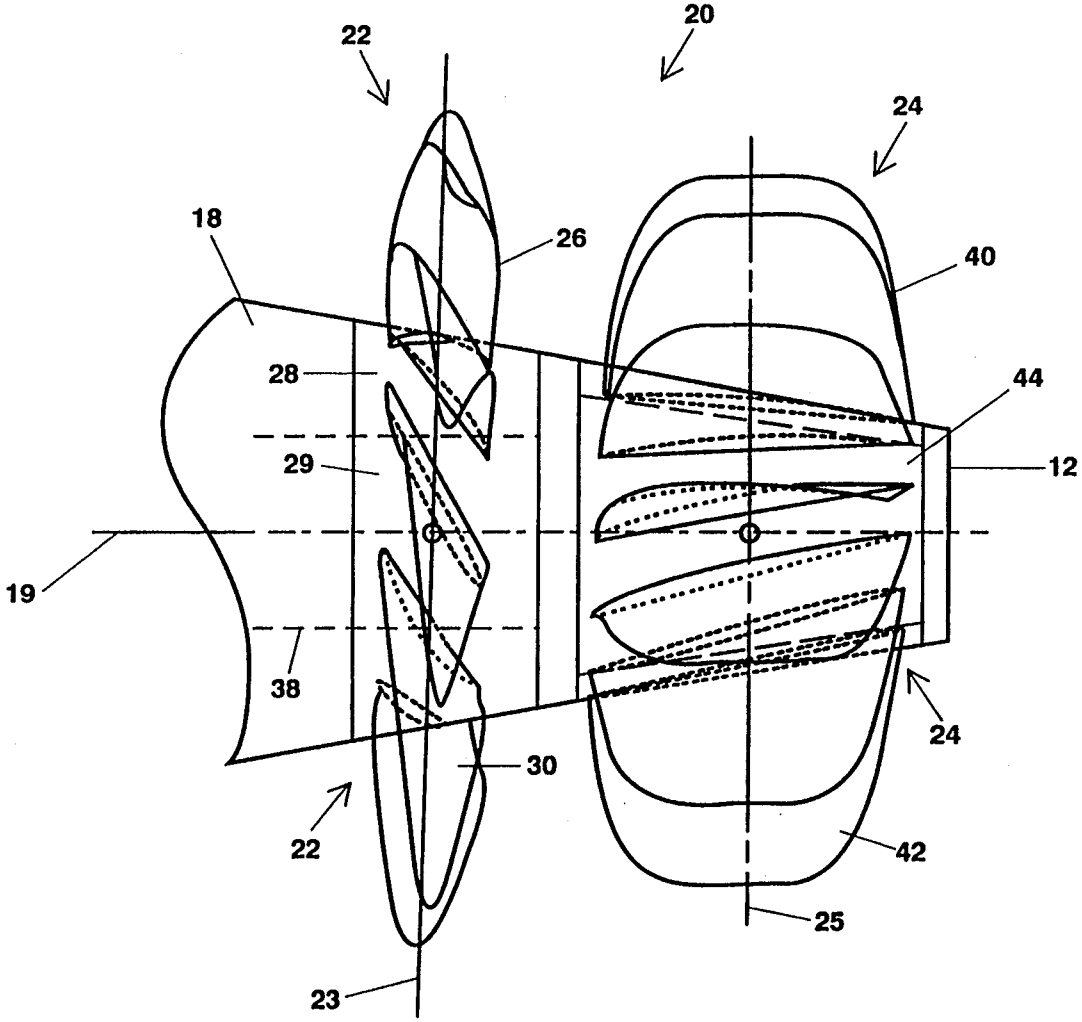
FIG. 2. is a side view of the aft section of the submersible vehicle of the present invention showing the torque balanced postswirl propulsor unit mounted thereon.

Referring now to the drawings, and particularly to FIGS. 1–2, submersible vehicle 10 having torque balanced postswirl propulsor unit 20 mounted thereon is shown. Postswirl propulsors consist generally of a stator comprising fixed blades or vanes installed behind a rotor comprising rotatable blades. Traditionally, postswirl propulsors have been used to achieve increases in propulsive efficiency and/or cavitation inception speed. The present invention further provides vehicle stability enhancement with a simple machinery package particularly suitable for small submersible vehicles. Although in a preferred embodiment, the torque balanced postswirl propulsor unit of the present invention is applied to a small submersible vehicle, it is not limited to small vehicles but is applicable to submersibles of any size where torque balance is desirable. For example, submarines, which generally use large control surfaces to balance the torque associated with the propulsor, can use the present invention to provide torque balance without requiring large deflections of the control surfaces, thus, minimizing resistance.

Herein, in the specification and claims, the term "small" when referring to a "small submersible vehicle" refers to a submersible vehicle such as vehicle 10 having a small maximum transverse dimension. Thus, a "small submersible vehicle" applicable to the present invention has a maximum hull transverse dimension (maximum diameter if the vehicle is composed of sections being nominally axisymmetric) of between about 5 and about 80 inches. Because in a preferred embodiment, vehicle 10 has a small maximum diameter, and thus propulsor unit 20 has a small diameter, torque balanced propulsor unit 20 of the present invention generally operates in a low blade Reynolds number flow environment. Consequently, flow separation,is a potential problem in the propulsor design.

As shown in FIG. 1, vehicle 10 generally comprises a watertight hull having bow 11 and stern 12, and including therebetween rounded forward section 14, longitudinally extending central section 16, and tapered aft section 18. The forward, central and aft sections are preferably bodies of revolution being axisymmetric about vehicle longitudinal axis 19. However, the present invention is also applicable to vehicles that are not axisymmetric. Forward section 14 is rounded and may have a blunt or flat nose corresponding to bow 11. Central section 16 includes therein the vehicle's maximum diameter transverse cross-section. Although central section 16 is preferably a cylindrical section, it need not have a constant diameter, such as with a barrel shaped section. Aft section 18 is a tapered body of revolution such as a cone or frustum, but need not have linearly decreasing cross-sections.

Referring to FIG. 2, torque balanced postswirl propulsor unit 20 of the present invention is mounted to aft section 18 of vehicle 10. Propulsor unit 20 comprises forward rotating means 22 and aft stationary means 24. In order that stationary means 24 be located within the wake of rotating means 22, rotating means 22 and stationary means 24 are located relative to each other such that the axial spacing between longitudinal centerplane 23 (i.e., fore-aft vertically oriented centerplane) of rotating means 22 and longitudinal centerplane 25 of stationary means 24 is equal to between about 30% and about 50% of the diameter of rotating means 22, preferably between about 35% and about 45%, and more preferably approximately 40%.

Rotating means 22 comprises a propeller or rotor 26 having central axisymmetric hub 28 that conforms to the shape of aft section 18, and a plurality of circumferentially spaced apart propeller or impeller blades 30 extending radially therefrom. Hub 28 has an axis of rotation and is adapted for being mounted for rotation with rotating shaft 38 of vehicle 10. Blades 30 are shaped to produce a thrust and a first torque associated with rotating rotor 26. To protect the rotor during storage, launching, and operation, the diameter of rotor 26 of the present invention is restricted to being less than or equal to about 96% of the maximum diameter of vehicle 10.

Figure 3B:
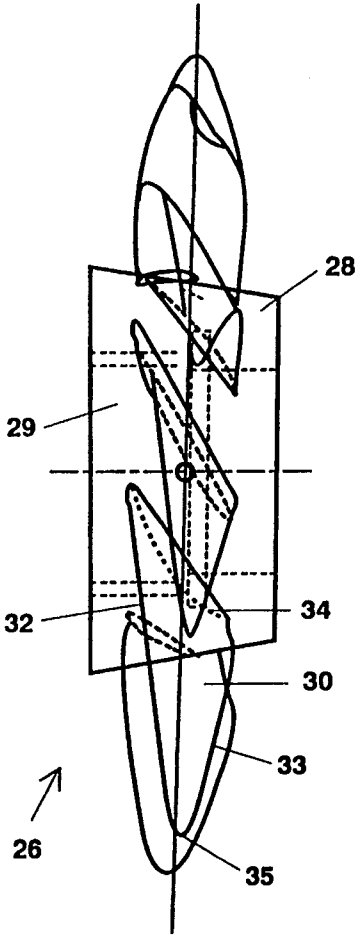
FIGS. 3A and 3B are front and side views of a rotor in accordance with the present invention..
Figure 3A:
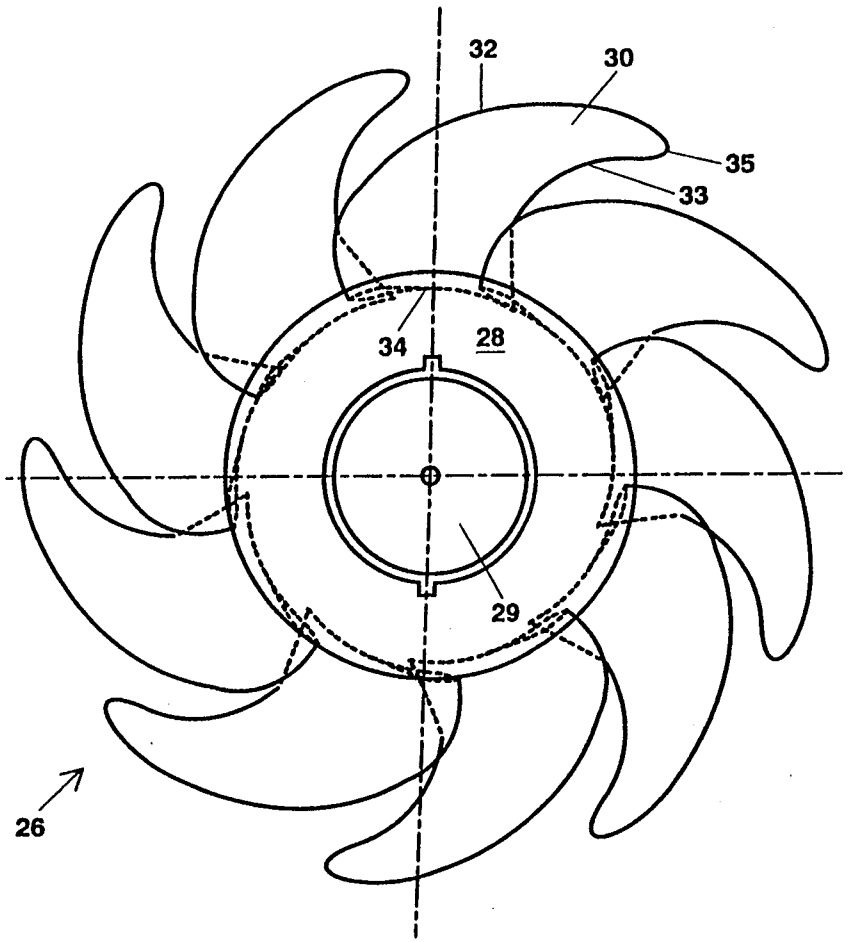

Referring to FIGS. 2 and 3, in a preferred embodiment, rotor 26 is rotationally mounted to aft section 18 of vehicle 10. Rotor 26 includes a plurality of impeller blades 30 that are equidistantly mounted or attached around the circumference of axisymmetric hub 28. Hub 28 is shaped to provide a smooth transition, at both its forward and aft extensions, into aft section 18. Hub 28 includes central bore 29 for mounting hub 28 for rotation with rotating shaft 38. Blades 30 may be separately attached to hub 28 in any well known fashion, such as by bolting, screwing, welding, or adhesion, or may be integrally formed with hub 28. Blades 30 each have a leading edge 32 and a trailing edge 33 that defines their chordlengths, and a root 34 and a tip 35 that defines their spans. Blade chordlength may vary with span. Blades 30 are attached at their roots 34 to hub 28. Each of blades 30 have streamlined cross-sections, that preferably comprise airfoil or hydrofoils shapes, such as for example NACA sections.

Rotor 26 is designed for a specific predetermined hub shape (hub conforms to shape of aft section) and rotor diameter, and a required thrust at a predetermined operating point (i.e., at a predetermined vehicle forward speed and rotor rotational speed). During the design, the number of blades, chordlength distribution (chordlength as a function of rotor radius), thickness distribution (thickness as a function of rotor radius), skew distribution (skew angle as a function of rotor radius), pitch distribution (pitch angle as a function of rotor radius), camber distribution (camber as a function of rotor radius), and circulation distribution (circulation as a function of rotor radius) that produce the required operational thrust at the operating point are determined. These values define the final design geometry of rotor 26. Rotor 26 also produces an operational torque at the predetermined operating point. This torque tends to create a roll moment on the vehicle which must be compensated for to maintain required vehicle stability.

Stationary means 24 comprises stator 40 having a plurality of stationary vanes 42 adapted to be fixed to aft section 18 of vehicle 10 in a circumferentially spaced arrangement. Vanes 42 are shaped to produce a torque associated with stator 40 when stator 40 is functioning in the wake of rotating rotor 26. In order that stator 40 be located fully within the wake of rotor 26 and that the tip vortices generated by rotor blades 30 do not impinge on stator vanes 42, the diameter of stator 40 of the present invention is restricted to being less than or equal to about 85% of the diameter of rotor 26.

Figure 4B:
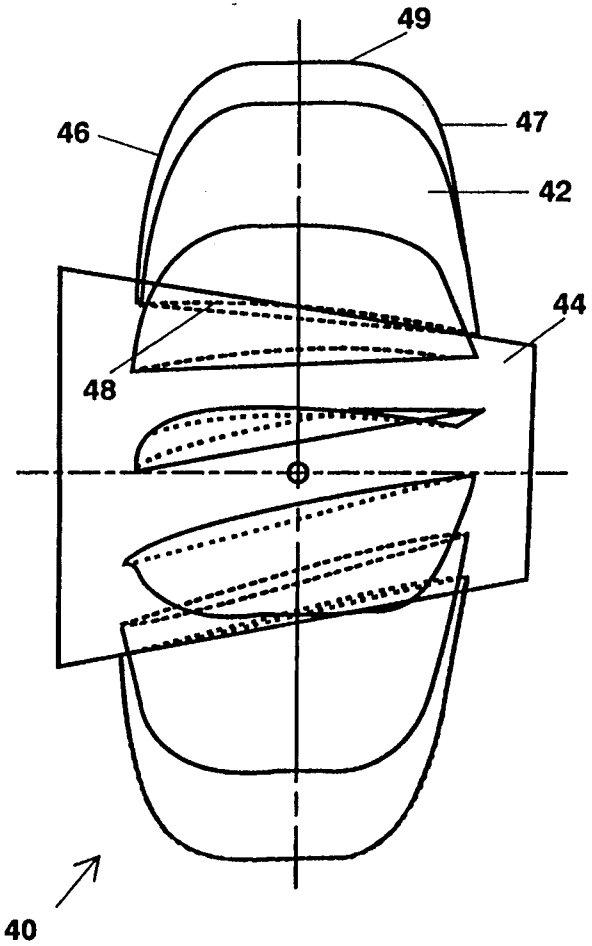
FIGS. 4A and 4B are front and side views of a stator in accordance with the present invention.
Figure 4A:
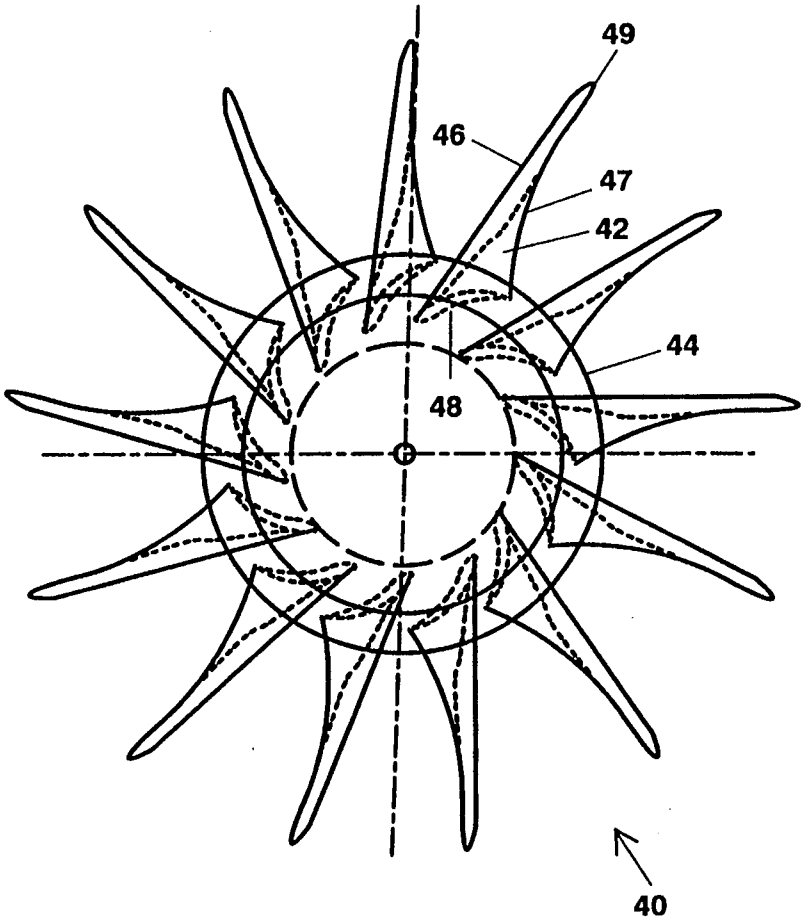

As shown in FIGS. 2 and 4, in a preferred embodiment, stator 40 includes a plurality of stationary vanes 42 mounted or attached around the circumference of aft section 18 aft of rotor 26. Vanes 42 may be individually attached directly to the outer surface of aft section 18 in any well known fashion, such as by bolting, screwing, welding, or adhesion. Alternatively, vanes 42 may be integrally formed with a hub or annular ring 44 which is then fixedly mounted so as to be flush with the surface of aft section 18. Alternatively, vanes 42 may be integrally formed with aft section 18, or with a portion of aft section 18 that is then attached to the remaining portions of aft section. 18. Vanes 42 each have a leading edge 46 and a trailing edge 47 that defines their chordlengths, and a root 48 and a tip 49 that defines their span. Vane chordlengths may vary with span. Vanes 42 are attached at their roots 48 to hub or annular ring 44 or directly to aft section 18.

Once the axial spacing between rotor 26 and stator 40 is set, the shape of stator hub 44 is known (conforms with shape of aft section). Stator 40 is designed to have a specific stator diameter, number of vanes, chordlength distribution (chordlength as a function of stator radius), thickness distribution (thickness as a function of stator radius), skew distribution (skew angle as a function of stator radius), pitch distribution (pitch angle as a function of stator radius), camber distribution (camber as a function of stator radius), and circulation distribution (circulation as a function of stator radius) to produce a torque substantially equal and opposite to the torque produced by rotor 26 at the predetermined operating point. These values define the final design geometry of the stator. Blades 30 of rotor 26 and vanes 42 of stator 40 are pitched oppositely with respect to each other in order to produce torque in opposite directions.

In a preferred embodiment, vehicle 10 has a small maximum diameter, and thus propulsor unit 20 has small diameters. Consequently, rotor 26 and stator 40 of the present invention generally operates in a low blade Reynolds number (Rn) flow environment. A low blade Reynolds number flow environment corresponds to flow over the blades at or below the transition point between laminar and turbulent flow. Generally, the Rn for flow transition on an airfoil is $3.0\times10^6$. However, due to the viscous wake of the rotor, turbulent disturbances increase on the stator. Additionally, the resulting variation of stator leading edge angle of attack produces low pressure over part of the stator vanes. As a result, transition from laminar to turbulent flow will occur at a lower Rn. Consequently, flow separation is a potential problem in the propulsor design. By keeping the blade section lift coefficient ($C_L$) low, the possibility of flow separation can be minimized. Consequently, the preferred embodiment of the present invention is restricted to $C_L \leqq 0.5$ for the rotor and $C_L \leqq 0.2$ for the stator. The definition of lift coefficient is $C_L = L/0.5\rho Vr^2c$, where: L is the lift $=\rho Vr\Gamma$; $\rho$ is the fluid density; Vr is resultant velocity over the blade; c is blade chord length; and Γ is the circulation. Thus, the number of blades 30 or vanes 42 and their respective chordlength, camber distributions, and circulations are determined to ensure that the blade or vane section lift coefficients of rotor 26 and stator 40 are less than about 0.5 and 0.2, respectively. Rotor 26 and stator 40 generally have an odd number of blades or vanes. Stator diameter is less than rotor diameter. Moreover, the number of stator vanes is generally greater than the number of impeller blades.

As is shown in FIG. 1, rotating shaft 38 is connected at one end to rotational power source 50 and is journal mounted at the opposite end to bearing (not shown) which may be mounted within aft section 18 or within fixed hub 44 of stator 40. Power source 50 may be any means of powering a rotating shaft such as a diesel motor or turbine-generator with associated mechanical drive system, or an electric drive system. Well known means of powering small submersible vessels include electric motors and chemically fueled boiler systems. The annular bearing is positioned in the aft section 18 aligned with the axis of rotation of rotor 26, which corresponds to vehicle longitudinal axis 19, for receiving the free aft end of shaft 38 that extends aft of rotor hub 28. The bearing may act as a thrust bearing for shaft 38. The bearing may be of any of the well known water lubricated or sealed type annular bearings generally used in rotating machinery. Suitable power sources and bearings are well know in the art and are not intended as limitations on the present invention.

In operation, the rotating rotor produces a forward thrust on the vehicle and also imparts a torque that tends to roll the vehicle in the direction of the torque. Water is accelerated by the rotating rotor in the longitudinal, tangential and radial directions of the rotor plane and, thus, imparts a spin to the rotor wake. As the wake of water is propelled aft it encounters the fixed stator blades. The orientation and shape of the stator blades impart a torque to the vehicle which counteracts the torque produced by the operating rotor. Thus stability is enhanced. At a predetermined operating point, the rotor and stator are design to produce substantially equal and opposite torques, thus producing torque balance and imparting a negligible or zero resulting roll force to the vehicle.

In designing torque balanced postswirl propulsor unit 20, three fundamental principles need to be satisfied: conservation of momentum, mass, and circulation. The principles of momentum, mass, and circulation conservation are well known in the art, so only a cursory review will be presented here. Momentum conservation requires that the net force generated by the postswirl propulsor be balanced by the vehicle barehull drag and the drag due to propulsor-hull interactions. Mass conservation determines the circulation distribution of the stator once the circulation distribution of the rotor is specified. Circulation conservation determines the magnitude of the stator circulation once the magnitude of the rotor circulation is specified. The magnitude of the stator circulation is calculated such that total circulation is conserved.

Figure 5:
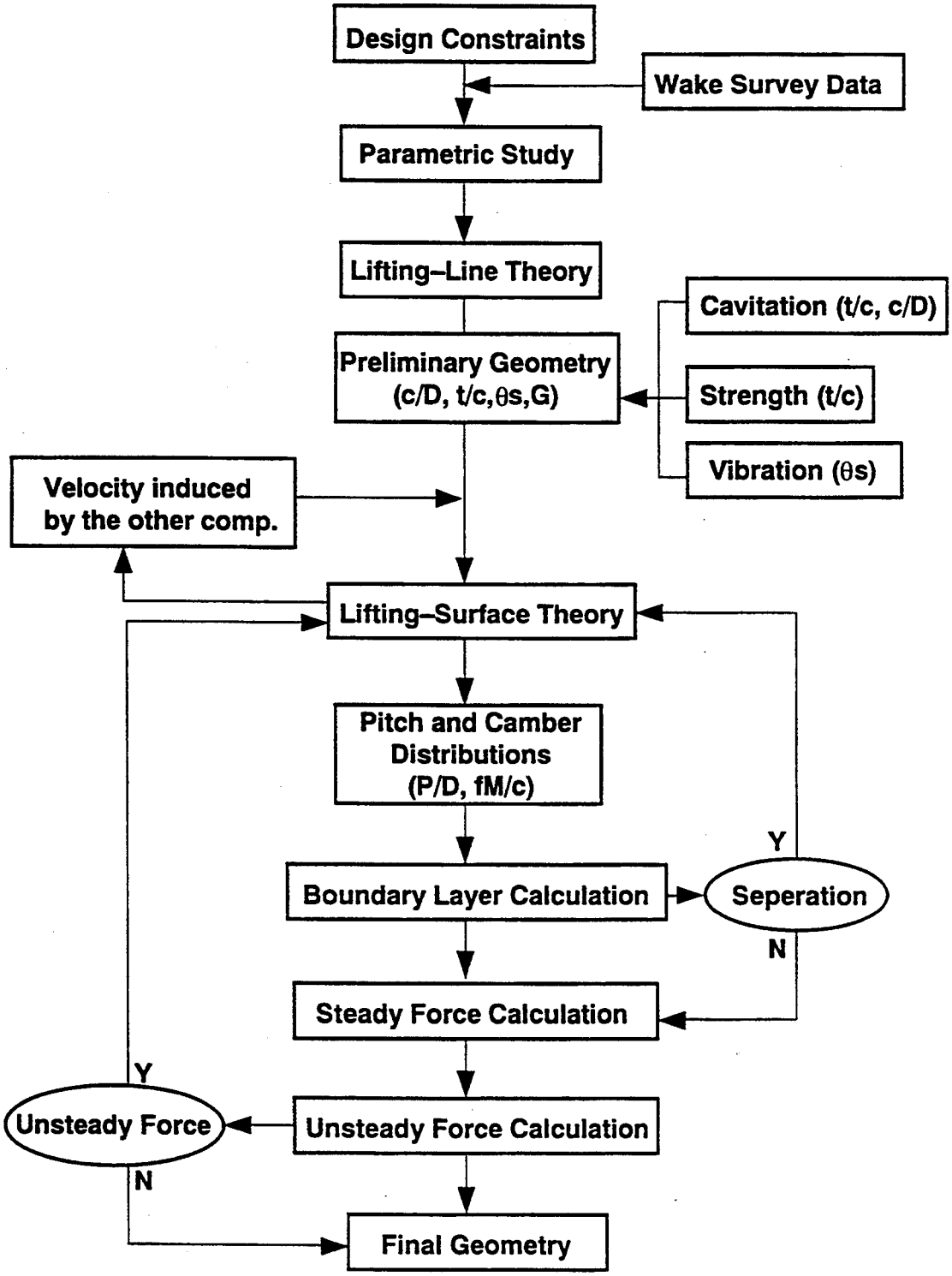
FIG. 5 is a flow chart of a design methodology for designing a propulsor in accordance with the present invention.

FIG. 5 presents a flow chart of the design method for torque balanced post swirl propulsor 20 of the present invention. Design methods for designing propellers are well known in the art. A preferred design procedure is presented below and is more fully described in Carderock Division Naval Surface Warfare Center, Ship Hydromechanics Department Research and Development Report number CARDEROCKDIV-92/011, entitle "Postswirl Propulsors—A Design Method and an Application," by Benjamin Y.-H. Chen (September 1992), incorporated herein by reference. The design procedure consists of three phases: specification of operating conditions, design, and analysis. During the first phase, the design requirements and the wake survey data (measurement of axial, radial and tangential flow velocities in the propulsor plane in the absence of the propulsor) are provided. The effects of the vehicle hull on the flow and the hull-propulsor interaction are traditionally represented by the nominal wake (wake in the propulsor plane in the absence of a propulsor) and two interaction coefficients: the thrust deduction factor and the wake fraction. These input values can be obtained from a model wake survey and resistance and propulsion experiments with a stock propulsor. Alternatively, these values can be obtained using any of many well known numerical computer programs for computing airfoil or propeller performance and predicting free-field velocity distributions. Such programs employ panel methods to model the vehicle, propeller and incompressible potential flow theory to compute velocity distributions, and boundary layer methods to determine vehicle resistance and propulsor inflow boundary layer profiles.

The design phase consists of three stages: preliminary, intermediate and final design stages. During the preliminary design phase, the effects of varying a limited number of design parameters (e.g., diameter, angular velocity, number of blades and radial distribution of loading) are investigated. The preliminary design stage uses lifting-line theory to perform a parametric study to determine optimum rotor and stator diameters, rotation speeds, and number of blades. Circulation distributions for the rotor and stator are also determined. Propulsive efficiency is calculated and considered in choosing the preliminary design values for the rotor and stator.

In the intermediate design stage, cavitation inception and blade or vane strength are the major factors in determining thickness, chordlengths, and blade or vane loading distributions for the rotor and stator. Blade surface cavitation and tip vortex cavitation calculations are performed for both rotor and stator.

The final design stage employs lifting-surface theory to incorporate three dimensional flow-field effects into the design. The effects of the rotor and stator hubs are represented. During this stage, pitch and camber distributions are determined.

During the analysis phase, steady and unsteady forces and moments are calculated using inverse lifting-surface programs. To determine the resultant steady thrust, torque and efficiency of the propulsor under design (operating point) and off design conditions, a vortex lattice method including hub effects is employed. The design is complete when unsteady shaft forces and moments are below predetermined design requirements.

Once the geometric parameters (chordlength, thickness, skew, rake, pitch and camber distributions) of the final design are determined, the X, Y and Z coordinates of the blade or vane surfaces can be determined using, for example, any of numerous well known computer aided design/computer aided manufacturing (CAD/CAM) software packages. The data can then be input into, for example, a numerical cutting or milling machine to produce the finished product.

EXAMPLE

In an exemplary, preferred embodiment of the present invention, a postswirl propulsor design for a small vehicle sought to maximize propulsive efficiency while minimizing propulsor noise due to cavitation and unsteady forces, and provide substantial cancellation of the rotor torque by the stator for stability. During the design process, a design that would deliver cavitation free operation and substantially zero resulting torque at the operating point and would minimize residual torque at off design points was desired. The design of an exemplary torque balance postswirl propulsor for a small vehicle is more fully described in a paper entitled "A Postswirl Propulsor For A Small Vehicle," by Benjamin Y.-H. Chen and Carol L. Tseng, presented at Propellers/Shafting '94 Symposium, Sept. 20–21, 1994, in Virginia Beach, Va., incorporated herein by reference.

Several design constraints were placed on the propulsor due to the small size of the vehicle. The thrust loading coefficient, $C_{TH}$, was set at 0.753. The vehicle diameter was 6.25 inches and the rotor diameter was set at 6.0 inches. Machinery limitations dictated that the maximum shaft horsepower available was 6.7 Hp and the rotational speed at the operating point was 3500 rpm.

Due to the small size of the propulsor, the maximum Reynolds numbers encountered were $0.72\times10^6$ for the rotor and $0.33\times10^6$ for the stator. At the minimum operating speed, the Reynolds numbers drop to $0.40\times10^6$ for the rotor and $0.19\times10^6$ for the stator. At these low Reynolds numbers there is the danger of flow separation over the blades or vanes which will cause thrust loss on the rotor and torque loss on the stator.

The resistance of the propeller body and the mean velocity profile for flow at the rotor and stator planes (for powering calculation), the circumferential velocity distribution at the rotor and stator planes (for blade surface cavitation analysis), and the interaction coefficients (thrust deduction factor of 0.86 and wake fraction of 0.85) were determined.

Design parameters were chosen based on a parametric study. The stator diameter was determined through mass conservation. To ensure that the stator operates inside the tip vortices of the rotor, the final stator diameter (5.1 inches) was chosen to be slightly smaller than the preliminary diameter calculated using mass conservation. Axial spacing was equal to 40% of the rotor diameter. To minimize the possibility of flow separation, values of blade section lift coefficients of the rotor and stator were restricted to being less than or equal to 0.5 and 0.2, respectively.

Figure 6:
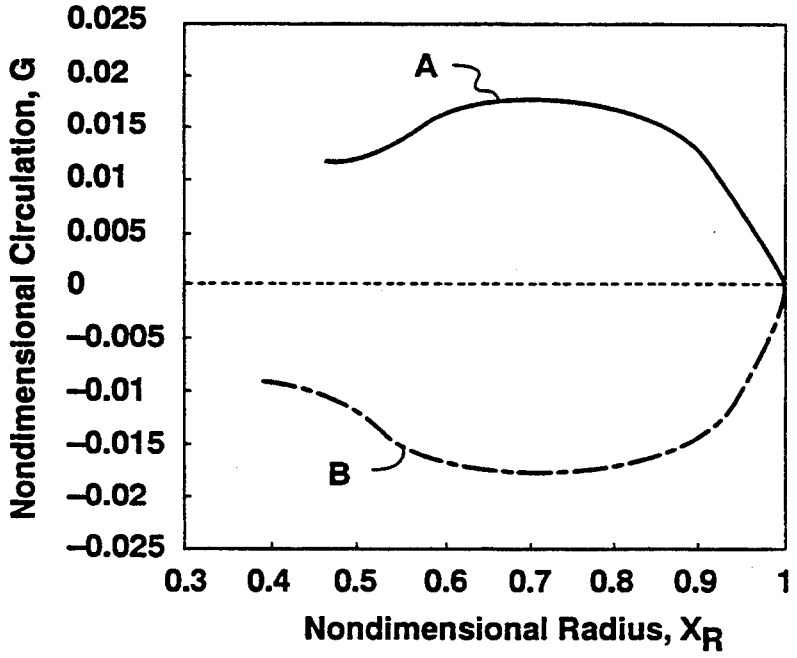
FIG. 6 shows the circulation distribution for an exemplary embodiment of the rotor and stator.

Lifting-line calculation were used to determine the circulation distribution of the rotor and stator. The circulation distribution to produce optimum propulsive efficiency was used for the rotor and the circulation distribution for the stator was adjusted to maximize torque cancellation. The stator was designed to substantially cancel rotor torque at the operating point and to minimize residual torque at off design conditions. Any residual torque at off design points must be balanced by the control surfaces. To ensure no tip vortex cavitation for both the rotor and stator, the circulation at the rotor and stator tips was unloaded (e.g., see FIG. 6) although the large chordlengths and low lift coefficient produced a low circulation at the tips. FIG. 6 shows the circulation distribution for the rotor (line A) and stator (line B).

The number of rotor blades was set at 9 and the number of stator vanes was set at 13. The large number of rotor blades and stator vanes was necessary to bring the blade section lift coefficients under 0.5 and 0.2, respectively. The chordlength distributions for the rotor and stator were also chosen to reduce the lift coefficients.

During the intermediate design, a thickness distribution for the rotor and stator was chosen based on strength and cavitation considerations. The material chosen for the propulsor was marine grade 7075 aluminum. The strength requirement at full power condition was not to exceed 12,500 psi. Stress calculation for the rotor and stator were performed using a simple beam theory. Blade and vane surface cavitation calculations were performed using two-dimensional airfoil theory.

Figure 8:
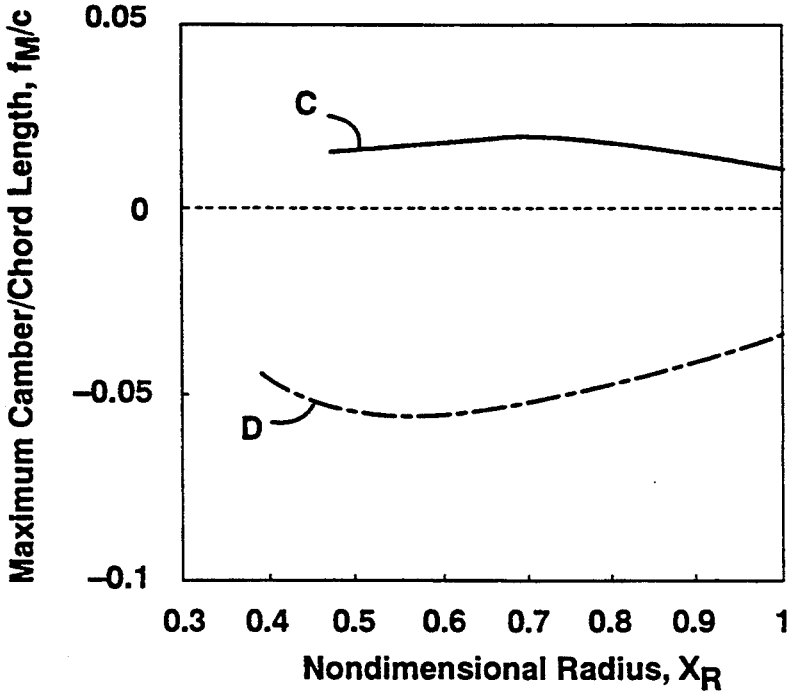
FIG. 8 presents final camber distributions for an exemplary embodiment of the rotor and the stator.
Figure 7A:
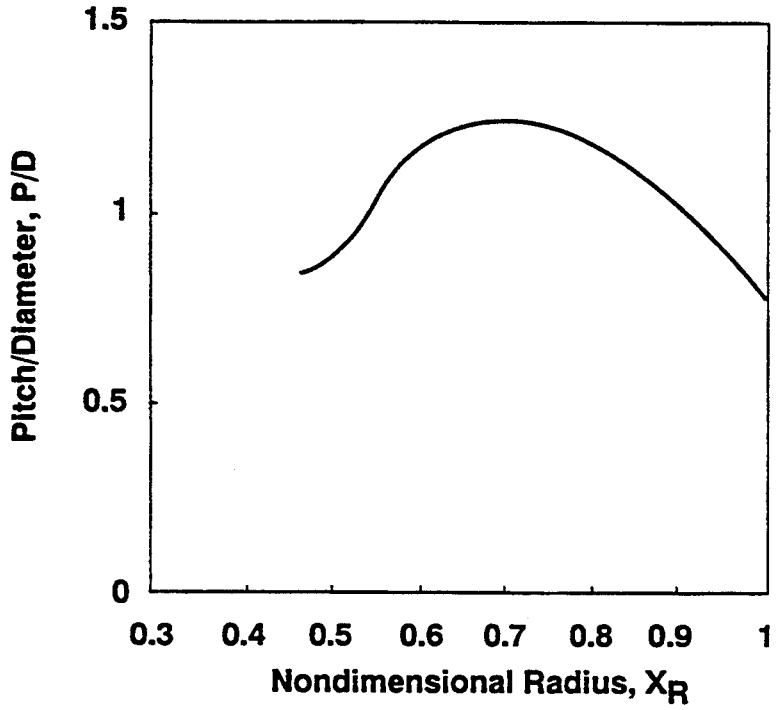
FIGS. 7A and 7B show the final faired pitch distribution for an exemplary embodiment of the rotor and the final faired pitch angle distribution for an exemplary embodiment of the stator, respectively.
Figure 7B:
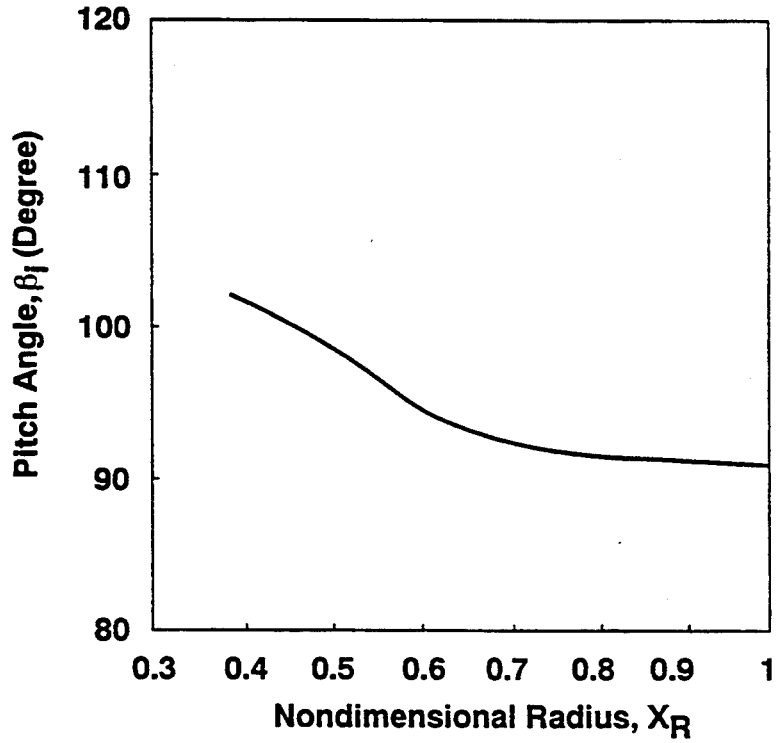

The final pitch and camber distributions were determined using lifting-surface theory and included hub effects. The induced velocities on the stator were calculated by lifting-line calculations. An a=0.8 meanline loading and a modified NACA 66 thickness form were used. FIGS. 7A and 7B show the final faired pitch distribution of the rotor and the final faired pitch angle distribution for the stator, respectively. FIG. 8 presents final camber distribution for the rotor (line C) and the stator (line D).

The advantages of the present invention are numerous. The present invention provides a simple single rotation machinery arrangement that enhances vehicle stability by providing torque balance at a particular design condition (design speed and power) while achieving increased propulsive efficiency and increased cavitation inception speed. Moreover, the present invention provides substantial torque balance at off-design conditions. In addition, the invention provides improved blade rate noise performance.

The present invention and many of its attendant advantages will be understood from the foregoing description and it will be apparent to those skilled in the art to which the invention relates that various modifications may be made in the form, construction and arrangement of the elements of the invention described herein without departing from the spirit and scope of the invention or sacrificing all of its material advantages. The forms of the present invention herein described are not intended to be limiting but are merely preferred or exemplary embodiments thereof.

What is claimed is:

1. A torque balanced propulsor unit for a small submersible vehicle of the type having a rounded forward section, a longitudinally extending central section including therein a maximum transverse dimension of the vehicle, the maximum transverse dimension being less than or equal to about 80 inches, and a tapered aft section, at least the aft section being axisymmetric about a longitudinal axis of the vehicle, said torque balanced propulsor unit comprising:

rotating means for providing a forward thrust to the vehicle, said rotating means adapted for being rotationally mounted to the tapered aft section of the vehicle, said rotating means having a first torque associated therewith; and stationary means for producing a second torque, said stationary means adapted for being secured to the vehicle at a location aft of said rotating means, said stationary means configured and positioned so as to function within a wake of said rotating means to produce said second torque, said second torque being substantially equal and opposite said first torque;

wherein said rotating means comprises a rotor, said rotor having a diameter less than or equal to about 96% of the maximum transverse dimension of the vehicle, said rotor including a central axisymmetric hub conforming to a shape of the tapered aft section of the vehicle and having an axis of rotation, and a plurality of circumferentially spaced apart impeller blades extending radially from said central hub, said blades shaped to produce said thrust and said first torque, said blades having chordlengths and spans associated therewith, a number of said blades and said chordlengths of said blades being determined to ensure that a blade section lift coefficient of said rotor is less than about 0.5, and wherein said stationary means comprises a stator having a plurality of stationary vanes, said vanes adapted to be fixed to the vehicle in a circumferentially spaced arrangement, said vanes shaped to produce said second torque, said vanes having chordlengths and spans associated therewith, a number of said vanes and said chordlengths of said vanes being determined to ensure that a blade section lift coefficient of said stator is less than about 0.2.

2. A torque balanced propulsor unit as in claim 1, wherein said plurality of impeller blades is an odd number of blades.

3. A torque balanced propulsor unit as in claim 1, wherein a longitudinal spacing between said rotating means and said stationary means is equal to between about 30% and about 50% of said rotor diameter.

4. A torque balanced propulsor unit as in claim 1, wherein said stator has a diameter less than or equal to about 85% of a diameter of said rotor.

5. A torque balanced propulsor unit as in claim 4, wherein said plurality of stationary vanes is an odd number of vanes, said number of vanes being greater than said plurality of impeller blades of said rotor.

6. A submersible vehicle having a torque balanced propulsor unit, comprising:

a small diameter submersible vehicle including a bow and a stern said bow and stern having forward, central and aft sections therebetween, said sections being axisymmetric about a longitudinal axis, said central section including therein a maximum diameter of said vehicle, said maximum diameter being less than or equal to about 80 inches, said aft section being tapered, said vehicle having a rotatable shaft and power means operatively connected to said shaft for rotating said shaft;

rotating means mounted for rotation with said shaft for providing a forward thrust to said vehicle, said rotating means located at said aft section of said vehicle, said rotating means having a first torque associated therewith; and stationary means for producing a second torque, said stationary means secured to said vehicle at a location aft of said rotating means, said stationary means configured and positioned so as to function within a wake of said rotating means to produce said second torque, said second torque being substantially equal and opposite said first torque;

wherein said rotating means comprises a rotor, said rotor having a diameter less than or equal to about 96% of said maximum diameter of said vehicle, said rotor including a central axisymmetric hub having an axis of rotation corresponding to said longitudinal axis, said hub operatively mounted for rotation with said shaft of said vehicle, said hub corresponding to a shape of said aft section of said vehicle, and a plurality of circumferentially spaced apart impeller blades extending radially from said central hub, said blades shaped to produce said thrust and said first torque, said blades having chordlengths and spans associated therewith, a number of said blades and said chordlengths of said blades being determined to ensure that a blade section lift coefficient of said rotor is less than about 0.5, and wherein said stationary means comprises a stator having a plurality of circumferentially spaced apart stationary vanes fixed to said vehicle and extending radially therefrom, said vanes shaped to produce said second torque, said vanes having chordlengths and spans associated therewith, a number of said vanes and said chordlengths of said vanes being determined to ensure that a blade section lift coefficient of said stator is less than about 0.2.

7. A vehicle having a torque balanced propulsor unit as in claim 6, wherein said plurality of impeller blades is an odd number of blades.

8. A vehicle having a torque balanced propulsor unit as in claim 6, wherein a longitudinal spacing between said rotor and said stator is equal to between about 30% and about 50% of said rotor diameter.

9. A vehicle having a torque balanced propulsor unit as in claim 6, wherein said stator has a diameter less than or equal to about 85% of a diameter of said rotor.

10. A vehicle having a torque balanced propulsor unit as in claim 9, wherein said plurality of stationary vanes is an odd number of vanes, said number of vanes being greater than said plurality of impeller blades of said rotor.

11. A method for eliminating torque on a small diameter submersible body of revolution having a maximum diameter less than or equal to about 80 inches and having a single rotating propulsor unit, comprising the steps of:

mounting a rotating means on said body of revolution for providing a forward thrust to said body, said rotating means located at an aft section of said body, said rotating means having a first torque associated therewith; and fixedly attaching a stationary means to said body at a location aft of said rotating means and within a wake of said rotating means, said stationary means for producing a second torque, said second torque being substantially equal and opposite said first torque;

wherein said rotating means comprises a rotor, said rotor including a central axisymmetric hub conforming to a shape of said aft section of said body and having an axis of rotation for mounting said rotor for rotation on said body, and an odd number of circumferentially spaced apart impeller blades extending radially from said central hub, said blades shaped to produce said thrust and said first torque, said plurality of impeller blades have chordlengths and span associated therewith, said rotor having a diameter less than or equal to about 96% of a maximum diameter of said body, said number of blades and said chordlengths being determined so that a blade section lift coefficient of said rotor is less than about 0.5, and further wherein said stationary means comprises a stator having a plurality of circumferentially spaced apart stationary vanes fixed to said body and extending radially therefrom, said wines shaped to produce said second torque, said plurality of stationary vanes being an odd number of vanes, said number of vanes being greater than said number of impeller blades of said rotor, said stationary vanes having chordlengths and spans associated therewith, wherein said stator has a diameter less than or equal to about 85% of said diameter of said rotor, said number of vanes and said chordlengths being determined so that a blade section lift coefficient of said stator is less than about 0.2.

12. A torque balanced propulsor unit as in claim 11, wherein a longitudinal spacing between said rotor and said stator is equal to between about 30% and about 50% of said rotor diameter.

* * * * *